US006172554B1

(12) United States Patent
Young et al.

(10) Patent No.: US 6,172,554 B1
(45) Date of Patent: Jan. 9, 2001

(54) POWER SUPPLY INSENSITIVE SUBSTRATE BIAS VOLTAGE DETECTOR CIRCUIT

(75) Inventors: Pochung Young, Fremont; Li-Chun Li, Los Gatos, both of CA (US)

(73) Assignee: Mosel Vitelic, Inc., Hsin Chu (TW)

( * ) Notice: Under 35 U.S.C. 154(b), the term of this patent shall be extended for 0 days.

(21) Appl. No.: 09/160,363

(22) Filed: Sep. 24, 1998

(51) Int. Cl.[7] ..... G05F 1/10
(52) U.S. Cl. ..... 327/535; 327/537
(58) Field of Search ..... 327/534, 530, 327/535, 536, 537, 538

(56) References Cited

U.S. PATENT DOCUMENTS 4,964,082 * 10/1990 Sato et al. ..... 365/189.09
5,270,584 * 12/1993 Koshikawa et al. ..... 327/534
5,744,997 * 4/1998 Kang et al. ..... 327/537
5,744,998 * 4/1998 Ito et al. ..... 327/537
5,872,479 * 2/1999 Shin ..... 327/537
6,005,434 * 12/1999 Tsukikawa et al. ..... 327/537

* cited by examiner

*Primary Examiner*—Timothy P. Callahan
*Assistant Examiner*—Hai L. Nguyen
(74) *Attorney, Agent, or Firm*—Skjerven Morrill MacPherson LLP; Michael Shenker; Barmak Sani

(57) ABSTRACT

In accordance with the present invention, a circuit provides a bias voltage V1 which is substantially insensitive to variations of a power supply voltage powering the circuit. The circuit includes a detector circuit for generating a signal from the power supply voltage and the bias voltage V1, wherein the signal is substantially insensitive to variations in the power supply voltage while being responsive to the bias voltage V1. The circuit further includes a voltage generator circuit for generating the bias voltage V1 wherein the voltage generator is responsive to the signal such that the detector circuit and the voltage generator maintain the bias voltage V1 at a substantially constant value over power supply voltage variations. The detector circuit also includes a circuit for allowing bias voltage V1 to get arbitrarily close to the ground voltage but not allowing the bias voltage V1 to become positive.

42 Claims, 6 Drawing Sheets

POWER SUPPLY INSENSITIVE SUBSTRATE BIAS VOLTAGE DETECTOR CIRCUIT

BACKGROUND

1. Field of the Invention

The present invention relates to providing voltages.

2. Description of Related Art

Voltage generating circuits are widely used in electrical and electronic devices. For instance, substrate bias generator circuits, also referred to as back-bias generators, are used in semiconductor devices which require the substrate region to be biased to a predetermined voltage. For example, in dynamic random access memories (DRAM) the substrate region is negatively biased to prevent the DRAM cells from losing the stored information. The back-bias generator includes a voltage multiplier circuit, commonly referred to as charge pump, for providing the negative Back-Bias Voltage ($V_{BB}$). The charge pump is usually accompanied by a $V_{BB}$ detector circuit. The detector circuit regulates the charge pump such that $V_{BB}$ is maintained as close to a target $V_{BB}$ value as possible.

The detector circuit constantly senses the $V_{BB}$ voltage level, and if $V_{BB}$ becomes more negative than the target $V_{BB}$, the detector circuit turns off the charge pump thereby allowing $V_{BB}$ to drift back to the target $V_{BB}$; and if $V_{BB}$ becomes less negative than the target $V_{BB}$, the detector circuit turns on the charge pump to pump $V_{BB}$ back to the target $V_{BB}$.

FIG. 1 shows a conventional $V_{BB}$ detector circuit 17. Serially connected resistors R1 and R2 are coupled between the power supply Vcc and $V_{BB}$ terminal 15. Vcc is provided by a power supply external to the device, and $V_{BB}$ is generated internally by a charge pump (not shown). Inverter 12 has its input terminal connected to node 11 which is the node between R1 and R2. The output terminal of inverter 12 also provides the output terminal Q10 of the detector circuit 17. Output terminal Q10 is connected to the charge pump.

Vcc, R1, R2, and $V_{BB}$ form a voltage divider which sets the voltage $V_A$ at node 11 in accordance with the following equation:

$$V_A=[(R2\times Vcc)+(R1\times V_{BB})]/(R1+R2) \quad (1)$$

Resistors R1 and R2 are selected so that, for the nominal Vcc value and target $V_{BB}$, the voltage $V_A$ equals the trip point of inverter 12. If the charge pump causes $V_{BB}$ to become more negative than the target value, $V_A$ drops below the trip point of inverter 12 causing Q10 to go high. The high level at Q10 turns off the charge pump, allowing $V_{BB}$ to increase back to the target value. Alternatively, if $V_{BB}$ becomes less negative than the target $V_{BB}$, $V_A$ rises above the trip point of inverter 12 causing Q10 to go low. The low level of Q10 turns on the charge pump causing $V_{BB}$ to become more negative. Thus, $V_{BB}$ is maintained at the target value.

Circuit 17 however, suffers from a number of drawbacks, one of which is that $V_{BB}$ varies with changes in Vcc. In particular, as shown by equation (1), if Vcc increases, $V_{BB}$ has to become more negative to keep $V_A$ at the trip point of inverter 12 (this assumes that inverter 12 is designed so that its trip point is insensitive to Vcc). This increases junction leakage as explained in more detail below. The increased junction leakage adversely impacts the operation of the device. For example, in a DRAM the increased junction leakage can cause loss of information stored in the memory cells; and more generally, the high leakage current results in higher static power consumption, e.g., high stand-by current ($I_{SB}$).

As both Vcc and $|V_{BB}|$ increase, leakage current increases across the junction between Vcc-biased n+ diffusion regions in the $V_{BB}$-biased P-type substrate. This is more clearly illustrated in FIG. 2. FIG. 2 shows a P-type substrate 23 biased to $V_{BB}$ through the p+ diffusion region 22. The n+ diffusion region 21 represents one of many n+ diffusion regions biased to Vcc. The pn junction formed by the P-substrate 23 and the n+ diffusion 21 is reverse biased since a positive voltage Vcc is applied to the negatively charged n+ diffusion 21 and a negative voltage $V_{BB}$ is applied to the positively charged P-type substrate 23.

In accordance with the I–V characteristics of a pn junction, as the reverse voltage across the pn junction approaches the junction break down voltage ($V_{BD}$), larger leakage current flows through the junction. Therefore, an increase in Vcc and the resulting more negative $V_{BB}$, combine to cause a greater reverse voltage across the junction formed by the n+ region 21 and substrate 23.

The undesirable effects of the large leakage currents, such as high $I_{SB}$ and data loss in DRAM cells, are magnified as technology moves to smaller geometries and memory devices move to higher densities.

Another drawback of circuit 17 (FIG. 1) is that it does not prevent $V_{BB}$ from becoming positive. If $V_{BB}$ becomes positive by as little as 0.8V, junctions formed by Vss-biased n+ regions and the $V_{BB}$-biased substrate become forward biased. This can lead to latch-up which may destroy the device.

FIG. 3A shows a prior art detector circuit 37 which prevents $V_{BB}$ from becoming positive. Circuit 37 is identical to circuit 17 of FIG. 1 except that NMOS transistor M30 is connected between node 11 and R2. With the gate of M30 connected to Vss, M30 turns off when its source (lead 33) reaches minus one threshold voltage ($-V_{TN}$), $V_{TN}$ being that of M30. When M30 turns off, $V_A$ rises to Vcc. This causes the charge pump to turn on and pump $V_{BB}$ to a more negative voltage.

It is desirable to provide an improved $V_{BB}$ detector.

SUMMARY

The inventors have observed that it is sometimes desirable to obtain $V_{BB}$ values closer to 0V than those provided by the $V_{BB}$ detector of FIG. 3A. The $V_{BB}$ range for circuit 37 (FIG. 3A) is illustrated in FIG. 3B. The horizontal axis represents Vcc and the vertical axis represents $V_{BB}$. The threshold voltage $V_{TN}$ is that of M30 which is typically about 1V. Voltage $V_X$ represents the upper limit to which the charge pump may pump $V_{BB}$ (the upper limit typically equals the junction breakdown voltage $V_{BD}$). The region bounded by $-V_{TN}$ and $-V_X$ (shown as the cross-hatched region) represents the $V_{BB}$ voltage range which circuit 37 tolerates. Given the technology trend towards smaller geometries and the above-mentioned problems caused by the increased junction leakage, lower $V_{BB}$ target values in the range of −1V to 0V (e.g. −0.5V) are highly desirable.

Accordingly, a $V_{BB}$ detector circuit is needed wherein $V_{BB}$ is made insensitive to Vcc variations, and also the range of possible $V_{BB}$ values is increased without compromising power consumption.

In some embodiments of the present invention, a voltage is provided which is substantially insensitive to power supply voltage variations. In some embodiments, the voltage is a bias voltage $V_{BB}$. The substantial insensitivity to the power supply voltage variations is achieved in some embodiments by using a detector circuit which generates a signal substantially insensitive to power supply voltage variations. For example, in some detector circuit embodiments, the resistor R1 of FIG. 1 is replaced by a current source. The current provided by the current source is substantially insensitive to power supply voltage variations. As a result, the voltage on node 11 is substantially insensitive to power supply voltage variations. In some embodiments, the inverter 12 is also made substantially insensitive to power supply voltage variations. Therefore, $V_{BB}$ becomes substantially insensitive to power supply voltage variations.

Some embodiments of the present invention allow a voltage generated by a voltage generating circuit to get arbitrarily close to 0 volts while still not allowing the voltage to become positive. Thus, some $V_{BB}$ generators include a circuit that allows $V_{BB}$ to get arbitrarily close to 0 volts but does not allow $V_{BB}$ to become positive. In some embodiments, this is achieved by biasing the gate of transistor M30 of FIG. 3A to the threshold voltage VTN of transistor M30.

Other features and advantages of the invention are described below. The invention is defined by the appended claims.

DESCRIPTION OF PREFERRED EMBODIMENTS

Figure 1:
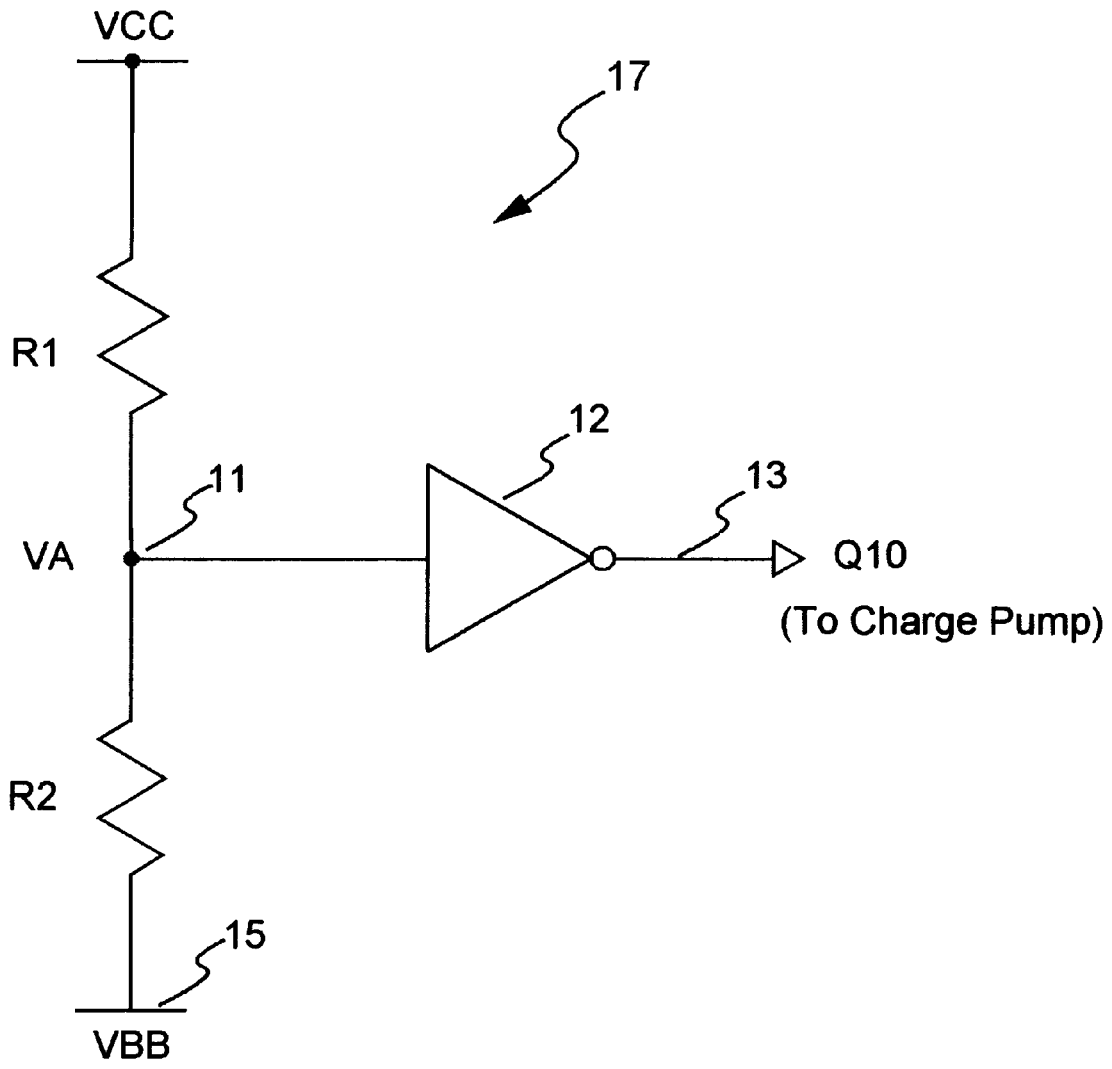
FIG. 1 (Prior Art)
FIG. 1 is a circuit diagram of a conventional $V_{BB}$ detector circuit.
Figure 2:
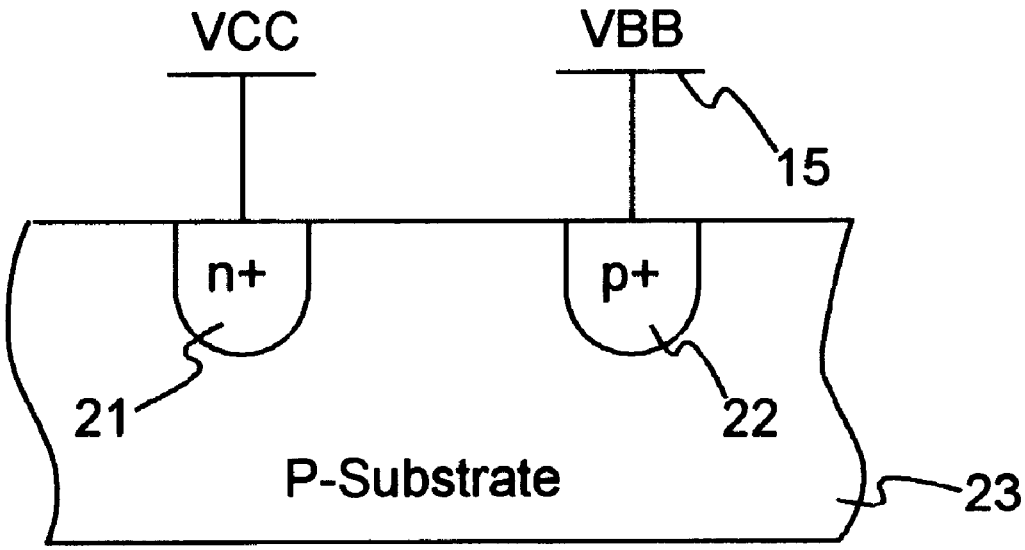
FIG. 2 (Prior Art)
FIG. 2 is a cross section of a portion of a prior art integrated circuit.
Figure 3A:
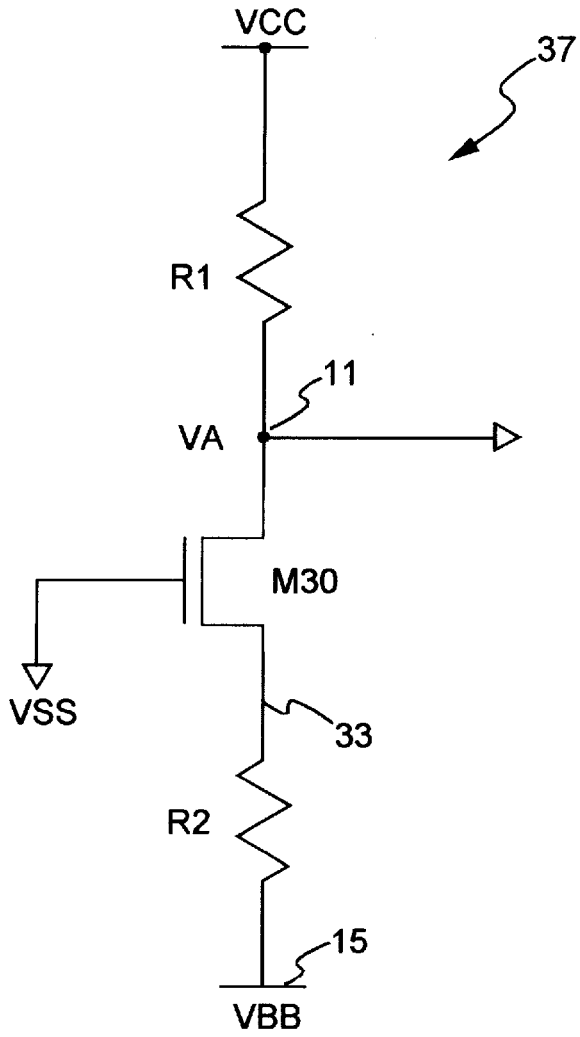
FIG. 3A (Prior Art)
FIG. 3A is a circuit diagram of a prior art $V_{BB}$ detector circuit which prevents $V_{BB}$ from becoming positive.
Figure 3B:
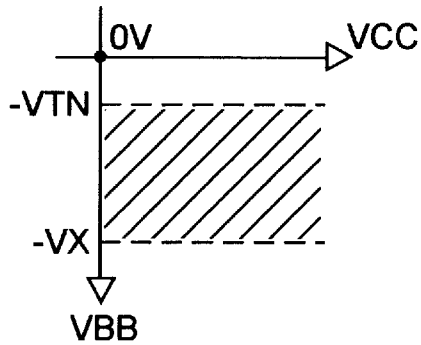
FIG. 3B (Prior Art)
FIG. 3B is a voltage diagram showing the $V_{BB}$ voltage range for circuit 37 of FIG. 3A.
Figure 4A:
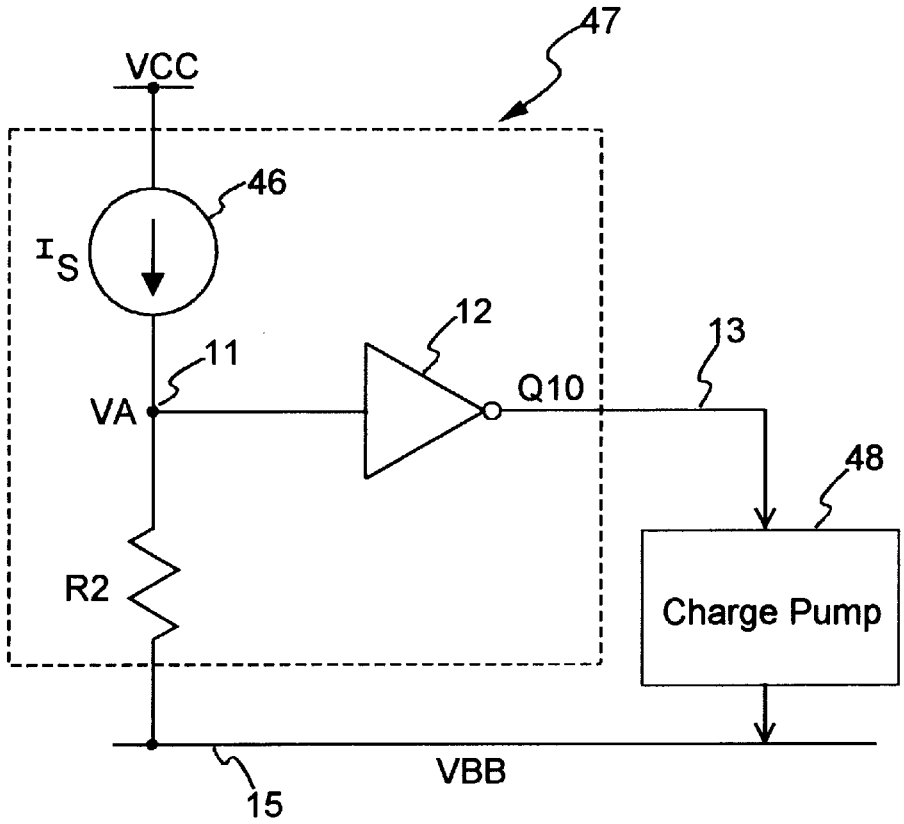
FIG. 4A is a circuit diagram of a $V_{BB}$ detector circuit in accordance with the present invention.

FIG. 4A shows a voltage detector circuit 47 in accordance with the present invention. The resistor R1 of FIG. 1 is replaced with a power-supply-voltage-insensitive current source 46. The current source 46 is connected between Vcc and node 11. Resistor R2 is connected between node 11 and $V_{BB}$ terminal 15 (note that R2 may be implemented using a MOS transistor, or a strip of polysilicon, or a strip of diffusion). Inverter 12 has its input terminal connected to node 11, and its output terminal represents the output terminal Q10 of the detector circuit 47. The output terminal Q10 is connected to an input terminal 13 of a charge pump 48. The charge pump 48 provides the voltage $V_{BB}$ on terminal 15.

The operation of circuit 47 is similar to that of circuit 17 in FIG. 1. However, by replacing R1 (FIG. 1) with the current source 46, the operation of the detector circuit 47 is made insensitive to Vcc variations. This is because the current source 46 provides a constant current despite Vcc variations.

The current equation written about node 11 yields the following:

$$V_A=(I_S\times R2)+V_{BB} \tag{2}$$

$I_S$ represents the constant current provided by current source 46. Unlike equation (1), equation (2) does not include Vcc. Thus, regulation of the charge pump 48 by the detector circuit 47 is not affected by changes in Vcc.

Figure 4B:
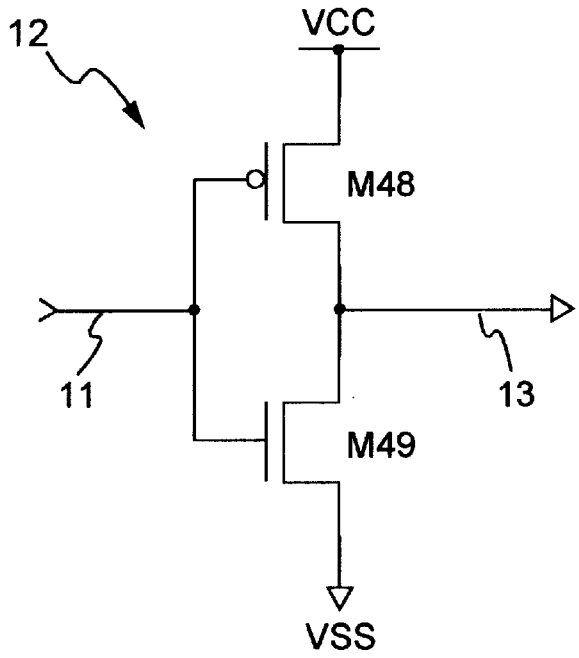
FIG. 4B is a circuit diagram of one implementation of inverter 12 of FIG. 4A.

Note that despite the absence of Vcc in equation (2), the trip point of inverter 12, to which $V_A$ is biased, may vary with Vcc. However, in some embodiments simple circuit techniques such as proper ratioing of the sizes of the pull up and pull down transistors of inverter 12 can be used to eliminate the dependence of inverter 12 trip point on Vcc. FIG. 4B shows a CMOS implementation of inverter 12 of FIG. 4A. By selecting a substantially larger transistor size for the pull down transistor M49 than the pull up transistor M48, the trip point of inverter 12 is made primarily dependent on the threshold voltage of the pull down transistor M49 and not Vcc.

Figure 5A:
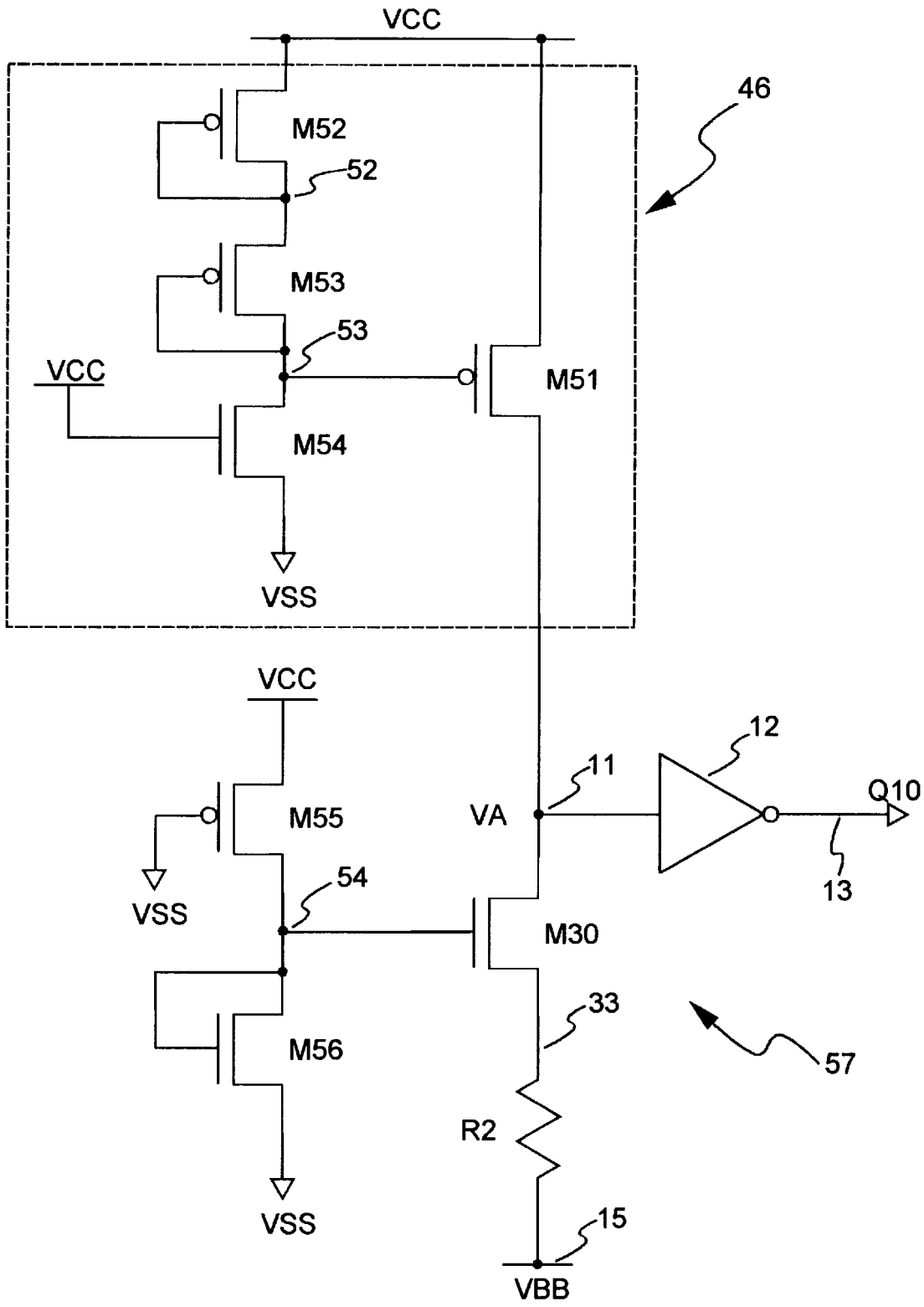
FIG. 5A is a circuit diagram of one embodiment of the detect or circuit 47 in FIG. 4A.

FIG. 5A shows another $V_{BB}$ detector circuit 57. Transistors M51, M52, M53, and M54 collectively implement a constant current source 46 which is also used in some embodiments of FIG. 4A. M51 is a PMOS transistor with its source connected to Vcc, its drain connected to node 11, and its gate connected to node 53. M52 is a PMOS transistor with its source connected to Vcc, and its gate and drain connected to node 52. M53 is a PMOS transistor with its source connected to node 52, and its gate and drain connected to node 53. M54 is an NMOS transistor with its drain connected to node 53, its gate connected to Vcc, and its source connected to Vss.

Transistors M30, M55 and M56 prevent $V_{BB}$ from becoming positive, and also set the upper limit for $V_{BB}$. M30 is a NMOS transistor with its drain connected to node 11, its gate connected to node 54, and its source connected to lead 33. M55 is a PMOS transistor with its source connected to Vcc, its gate connected to Vss, and its drain connected to node 54. M56 is a NMOS transistor with its drain and gate connected to node 54, and its source connected to Vss. Finally, resistor R2 is connected between lead 33 and $V_{BB}$ terminal 15.

The operation of circuit 57 will be described by first describing the operation of the section comprising M51, M52, M53, and M54, and then the operation of the section comprising M30, M55 and M56. As is well known, the current through a MOS transistor is a function of its gate to source voltage ($V_{GS}$) and its drain to source voltage ($V_{DS}$). Therefore, to eliminate the impact of Vcc on the current through transistor M51, we make its $V_{GS}$ and $V_{DS}$ independent from Vcc.

More particularly, M52 and M53 are diode connected so that the voltage at node 53 is at Vcc minus two threshold voltages (Vcc−2$|V_{TP}|$), where $V_{TP}$ is threshold voltage of the PMOS transistors in FIG. 5A. M54 is a small NMOS leaker transistor which is kept on at all times by connecting its gate to Vcc. M54 maintains a small amount of current flowing through M52 and M53 so that M52 and M53 bias node 53 to Vcc minus 2$|V_{TP}|$.

Hence, the gate to source voltage ($V_{GS}$) of M51 is:

$$V_{GS}=-2|V_{TP}| \tag{3}$$

which does not depend on Vcc.

The impact of Vcc variations on $V_{DS}$ is eliminated by maintaining M51 in saturation at all times. A PMOS transistor is in saturation as long as the following equation is satisfied:

$$|V_{DS}|\geqq(|V_{GS}|-|V_{TP}|) \tag{4}$$

$V_{TP}$ represents the threshold voltage of M51. $V_{GS}$ is provided by equation (3), and $V_{DS}$ is determined as follows:

$$V_{DS}=V_A-Vcc \quad (5)$$

Plugging equations (3) and (5) into equation (4) yields:

$$|V_A-Vcc|\geqq|V_{TP}| \quad (6)$$

Equation (6) is satisfied for $V_A$ values less than Vcc minus $|V_{TP}|$. Assuming Vcc to be 5V and $V_{TP}$ to be −1V, equation (6) is satisfied for any $V_A$ values less than or equal to 4V. Since $V_A$ is biased to be equal to the trip point of inverter 12, inverter 12 can be designed so that its trip point is below 4V. In fact, as mentioned earlier, to ensure circuit 57 is Vcc insensitive, the inverter 12 trip point is set close to $V_{TN}$ (a NMOS threshold) or about 1V.

The invention is not limited to the above-described circuit implementation of the current source 46 (FIG. 4A). For example, in obtaining a desired voltage across the gate to source of M51, some embodiments may include only one of transistors M52, M53 (FIG. 5A), or more than two such transistor. Alternatively, the current through M51 may be multiplied by current mirrors if needed.

Figure 5B:
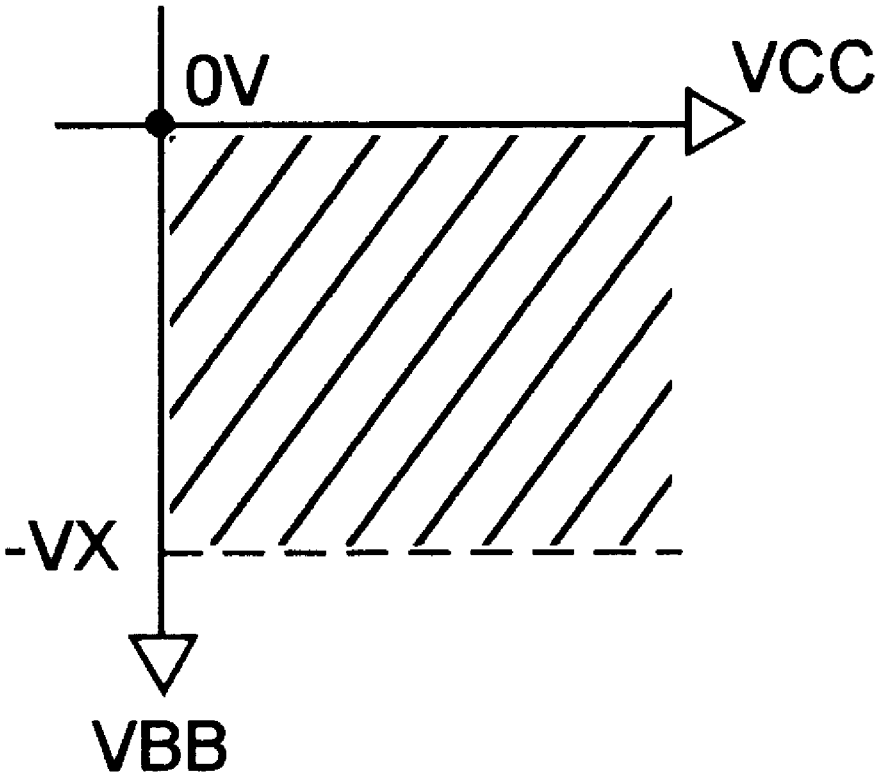
FIG. 5B is a voltage diagram showing the $V_{BB}$ voltage range for circuit 57 of FIG. 5A.

Transistors M30, M55 and M56 allow the $V_{BB}$ voltage range for circuit 57 to include the range between $-V_X$ and 0V, as indicated in FIG. 5B. This is made possible by biasing the gate of M30 (FIG. 5A) to $V_{TN}$ using M55 and M56. With its gate at $V_{TN}$ (1V), M30 turns off for source voltages (voltages at lead 33) greater than 0V.

The diode connected M56 causes node 54 to always remain at one $V_{TN}$ above Vss. M55 is a small PMOS leaker transistor which is kept on at all times by connecting its gate to Vss. M55 maintains a small amount of current flowing through M56 so that M56 biases node 54 to $V_{TN}$.

Note that by selecting small transistor sizes for the leaker transistors M54 and M55, the static power consumption of circuit 57 is minimized.

Also note that the power supply voltage Vcc in FIGS. 4A, 4B and 5A may be provided on a power supply pin of a device (such as a DRAM) in which circuit 57 is housed, or alternatively, Vcc is generated internal to such device as a reference voltage.

Finally, note that the $V_{BB}$ voltage may be applied to a silicon substrate in which the memory cells of an integrated memory (such as a DRAM) reside. Alternatively, $V_{BB}$ may be applied to a well region in which the memory cells of such integrated memory reside, the well region being formed in a silicon substrate having a conductivity type opposite the well region.

Addendum A at the end of this description provides transistor sizes and other implementation details for some embodiments.

The above description of the present invention is intended to be illustrative and not limiting. The invention is further intended to include all variations and modifications falling within the scope of the appended claims.

ADDENDUM A

The following table provides transistor width and length dimensions (in micrometers-$\mu$m) for some embodiments of FIG. 5A. Also, transistor sizes are provided for inverter 12 of FIG. 4B which is similar to inverter 12 of FIG. 5A.

| TRANSISTORS | WIDTH/LENGTH |
|---|---|
| FIG. 5A | |
| M51 | 4/100 |
| M52 | 4/1 |
| M53 | 4/1 |
| M54 | 4/400 |
| M55 | 4/400 |
| M56 | 15/1 |
| M30 | 15/1 |
| FIG. 4A | |
| M48 | 4/32 |
| M49 | 4/64 |

In these embodiments, the resistor R2 (FIG. 5A) is 2 Mega Ω. A suitable charge pump 48 (FIG. 4A) is described in U.S. patent application Ser. No. 08/853,291 filed on May 9, 1997, incorporated herein by reference, now U.S. Pat. No. 5,907,257, issued May 25, 1999.

What is claimed is:

1. A circuit for providing a bias voltage V1 which is substantially insensitive to variations of a power supply voltage powering the circuit, the circuit comprising:

a detector circuit for generating a signal from the power supply voltage and the bias voltage V1, wherein said signal is substantially insensitive to variations in the power supply voltage while being responsive to the bias voltage V1; and a voltage generator for generating the bias voltage V1 on an output terminal, wherein the voltage generator is responsive to said signal such that the detector circuit and the voltage generator are operable to maintain the bias voltage V1 at a substantially constant value over power supply voltage variations;

wherein the detector circuit comprises:

a bias circuit for biasing a first node to a node voltage, the bias circuit receiving the power supply voltage and the bias voltage V1; and a sensing circuit for generating said signal in response to the node voltage at the first node;

wherein the power supply voltage is provided across a power supply terminal and a reference terminal, and the bias circuit comprises:

a current source connected between the power supply terminal and the first node, the current source being substantially insensitive to power supply voltage variations; and a resistor connected between the first node and the output terminal of the voltage generator circuit;

wherein the current source comprises a first transistor connected between the power supply terminal and the first node, the first transistor being biased such that a current through the first transistor is substantially insensitive to power supply voltage variations;

wherein the gate to source voltage of the first transistor is made substantially insensitive to power supply voltage variations;

wherein the first transistor is a field effect transistor biased in the saturation mode;

wherein the sensing circuit comprises an inverter having an input terminal connected to the first node, the inverter possessing a trip point which is substantially insensitive to power supply voltage variations, whereby the bias voltage V1 is obtained when the node voltage and the trip point of the inverter are substantially the same.

2. The circuit of claim 1 wherein the inverter comprises:

a pull up transistor; and a pull down transistor, wherein the pull down transistor size is substantially larger than the pull up transistor size.

3. The circuit of claim 1 wherein the first transistor is a PMOS transistor having its gate biased to a voltage equal to the power supply voltage minus a predesignated voltage.

4. The circuit of claim 3 wherein the predesignated voltage is equal to two threshold voltages.

5. The circuit of claim 3 wherein the current source further comprises two PMOS transistors serially connected between the power supply terminal and the gate of the first transistor, each of the two serially connected PMOS transistors being diode-connected such that the gate of the first transistor is biased to the power supply voltage minus two threshold voltages when the two serially connected PMOS transistors are turned on, the two threshold voltages being those of the two serially connected PMOS transistors.

6. The circuit of claim 5 wherein the current source further comprises a leaker transistor connected in series with the two serially connected PMOS transistors for maintaining a small current through the two serially connected PMOS transistors.

7. The circuit of claim 6 wherein the leaker transistor is a NMOS transistor connected between the gate of the first transistor and the ground terminal, the gate of the NMOS transistor being connected to the power supply terminal.

8. The circuit of claim 1 wherein the bias circuit further comprises a second transistor for preventing the bias voltage V1 from exceeding a predesignated voltage.

9. The circuit of claim 8 wherein the predesignated voltage is 0V.

10. The circuit of claim 8 wherein the second transistor is a NMOS transistor NM1 connected between the first node and the resistor, the gate of the transistor NM1 being biased to one threshold voltage above the predesignated voltage.

11. The circuit of claim 10 wherein a NMOS transistor NM2 is connected between the gate of the transistor NM1 and the reference terminal, the gate of the transistor NM2 being connected to the gate of the transistor NM1.

12. The circuit of claim 11 wherein a leaker transistor is connected in series with the transistor NM2 for maintaining a small current flowing through the transistor NM2.

13. The circuit of claim 12 wherein the leaker transistor is a PMOS transistor connected between the power supply terminal and the gate of the transistor NM1, the gate of the leaker PMOS transistor being connected to the reference terminal.

14. The circuit of claim 1 wherein the resistor is implemented using a MOS transistor, or a strip of polysilicon, or a strip of diffusion.

15. A method for providing a bias voltage V1 which is substantially insensitive to variations of a power supply voltage powering a circuit, the method comprising:

(A) generating on an output terminal of a detector circuit a signal from the power supply voltage and the bias voltage V1, wherein said signal is substantially insensitive to variations in the power supply voltage while being responsive to the bias voltage V1; and (B) generating the bias voltage V1 on an output terminal of a voltage generator, wherein the voltage generator is responsive to said signal such that the detector circuit and the voltage generator are operable to maintain the bias voltage V1 at a substantially constant value over power supply voltage variations;

wherein step (A) comprises:

(C) biasing a first node to a node voltage by a bias circuit, the bias circuit receiving the power supply voltage and the bias voltage V1; and (D) generating said signal in response to the node voltage at the first node by a sensing circuit;

the method further comprising:

(E) preventing the bias voltage V1 from exceeding a predesignated voltage;

wherein:

the power supply voltage is provided across a power supply terminal and a reference terminal, and the bias circuit includes a current source which is substantially insensitive to power supply voltage variations, the current source being connected between the power supply terminal and the first node, and also includes a resistor connected between the first node and the output terminal of the voltage generator;

wherein the current source includes a first transistor biased such that a current through the first transistor is substantially insensitive to power supply voltage variations, the first transistor being connected between the power supply terminal and the first node;

wherein the gate to source voltage of the first transistor is made substantially insensitive to power supply voltage variations and the first transistor is a field effect transistor biased in the saturation mode;

wherein the sensing circuit includes an inverter having an input terminal connected to the first node, the inverter possessing a trip point which is substantially insensitive to power supply voltage variations, whereby the bias voltage V1 is obtained when the node voltage and the trip point of the inverter are substantially the same.

16. The method of claim 15 wherein the inverter includes a pull up transistor and a pull down transistor, the pull down transistor size being substantially larger than the pull up transistor size.

17. The method of claim 15 wherein the first transistor is a PMOS transistor having its gate biased to a voltage equal to the power supply voltage minus two threshold voltages.

18. The method of claim 17 wherein the current source further includes two PMOS transistors serially connected between the power supply terminal and the gate of the first transistor, each of the two serially connected PMOS transistors being diode-connected such that the gate of the first transistor is biased to the power supply voltage minus two threshold voltages when the two serially connected PMOS transistors are turned on, the two threshold voltages being those of the two serially connected PMOS transistors.

19. The method of claim 15 wherein the predesignated voltage is 0V.

20. The method of claim 15 wherein the bias circuit further includes a NMOS transistor NM1 for carrying out step (E), the transistor NM1 being connected between the first node and the resistor, the gate of the transistor NM1 being biased to one threshold voltage above the predesignated voltage.

21. The method of claim 20 wherein a NMOS transistor NM2 is connected between the gate of the transistor NM1 and the reference terminal, the gate of the transistor NM2 being connected to the gate of the transistor NM1.

22. A circuit comprising:

a voltage generator for generating a bias voltage V1; and a detector circuit for detecting the bias voltage V1 and regulating the voltage generator to maintain the bias voltage V1 at a substantially constant negative level, the detector circuit allowing the bias voltage V1 to get arbitrarily close to the ground voltage but not allowing the bias voltage V1 to become positive.

23. The circuit of claim 22 wherein the detector circuit comprises a voltage divider circuit connected between a power supply terminal and a reference terminal receiving the bias voltage V1, the voltage divider circuit comprising a transistor for preventing the bias voltage V1 from exceeding 0 volt.

24. The circuit of claim 23 wherein the transistor comprises a NMOS transistor NM1, the gate of the transistor NM1 being biased to one threshold voltage above 0 volt.

25. The circuit of claim 24 further comprising a NMOS transistor NM2 connected between the gate of the transistor NM1 and a ground terminal, the gate of the transistor NM2 being connected to the gate of the transistor NM1.

26. The circuit of claim 25 further comprising a leaker transistor connected in series with the transistor NM2 for maintaining a small current flowing through the transistor NM2.

27. The circuit of claim 26 wherein the leaker transistor is a PMOS transistor connected between the power supply terminal and the gate of the transistor NM1, the gate of the PMOS transistor being connected to the ground terminal.

28. The circuit of claim 22 wherein the bias voltage V1 biases a P-type region that makes junction with at least one N-type region, and the bias voltage V1 is operable to make the junction reverse biased.

29. The circuit of claim 28 wherein the circuit is a dynamic random access memory (DRAM) device.

30. An integrated circuit comprising a semiconductor region and also comprising a circuit C1 for providing a bias voltage V1 to bias the semiconductor region such that the bias voltage V1 is substantially insensitive to variations of a power supply voltage powering the circuit C1, the circuit C1 comprising:

a bias voltage terminal for providing the bias voltage V1;

a voltage generator for generating the bias voltage V1 on the bias voltage terminal;

a power supply terminal for receiving the power supply voltage;

a node;

a current source connected between the power supply terminal and the node, for providing current substantially insensitive to the power supply voltage variations;

a first circuit for providing a conductive path between the node and the bias voltage terminal, such that the current source and the first circuit bias the node to a voltage which is a function of the bias voltage V1; and an inverter for inverting a voltage signal on the node, the inverter possessing a trip point which is substantially insensitive to the power supply voltage variations, wherein the voltage generator turns on and off in response to an output signal of the inverter.

31. The integrated circuit of claim 30 wherein the inverter comprises:

a first transistor connected to a ground voltage terminal and to an output of the inverter; and a second transistor connected to the output of the inverter in series with the first transistor, wherein the first transistor size is substantially greater than the second transistor size.

32. The integrated circuit of claim 30 further comprising a memory wherein the bias voltage V1 is applied to a silicon substrate region in which memory cells reside.

33. The integrated circuit of claim 32 wherein the memory is a dynamic random access memory (DRAM).

34. The integrated circuit of claim 32 wherein the bias voltage is less than or equal to 0 volt.

35. The integrated circuit of claim 30 further comprising a memory wherein the bias voltage is applied to a well region in which memory cells reside, the well region being formed in a silicon substrate of a conductivity type opposite that of the well region.

36. The integrated circuit of claim 30 wherein the current source comprises a transistor connected between the power supply terminal and the node, the transistor being a field effect transistor biased in the saturation mode.

37. The integrated circuit of claim 36 wherein the transistor is a PMOS transistor having its gate biased to a voltage equal to the power supply voltage minus two threshold voltages.

38. An integrated circuit comprising:

a semiconductor region;

a voltage generator for generating a negative bias voltage to bias the semiconductor region;

a voltage regulator for regulating the voltage generator, wherein the voltage regulator comprises:

a bias voltage terminal for receiving the bias voltage;

a positive voltage terminal for receiving a positive voltage;

a node for providing a voltage to regulate the voltage generator;

a first circuit connecting the node to the positive voltage terminal; and a second circuit connecting the node to the bias voltage terminal, wherein the second circuit comprises:

a NMOS transistor connected between said node and the bias voltage terminal; and a bias circuit for biasing a gate of the NMOS transistor at a voltage VTN above ground, wherein the voltage VTN is a threshold voltage of the NMOS transistor, so that the transistor is on for any negative voltage on the bias voltage terminal but the transistor is off for any positive voltage on the bias voltage terminal.

39. The integrated circuit of claim 38 wherein the semiconductor region is a region of a semiconductor substrate.

40. The integrated circuit of claim 39 wherein the circuit comprises DRAM cells whose transistors are formed in the semiconductor region.

41. The integrated circuit of claim 38 wherein the NMOS transistor has its drain connected to said node, and the second circuit further comprises a resistor having a first terminal connected to the source of the NMOS transistor and also having a second terminal connected to the bias voltage terminal.

42. An integrated circuit comprising:

a semiconductor region;

a voltage generator for generating a negative bias voltage to bias the semiconductor region;

a node for providing a voltage to turn the voltage generator on and off;

a bias voltage terminal for receiving the bias voltage;

a positive voltage terminal for receiving a positive voltage;

a circuit for providing current from the positive voltage terminal to the node;

a NMOS transistor having a drain connected to the node;

a resistor having one terminal connected to a source of the NMOS transistor and having another terminal connected to the bias voltage terminal, wherein the resistor is implemented by a strip of polysilicon, or by a diffusion region, or by a transistor; and a bias circuit for biasing a gate of the NMOS transistor at a voltage VTN above ground, wherein VTN is a threshold voltage of the NMOS transistor.

* * * * *

UNITED STATES PATENT AND TRADEMARK OFFICE

CERTIFICATE OF CORRECTION

PATENT NO. : 6,172,554 B1
DATED : January 9, 2001
INVENTOR(S) : Pochung Young et al.

It is certified that error appears in the above-identified patent and that said Letters Patent is hereby corrected as shown below:

Column 3,
Line 39, delete “detect or” insert -- detector --.

Signed and Sealed this

Twenty-third Day of July, 2002

*Attest:*

*Attesting Officer*

JAMES E. ROGAN
*Director of the United States Patent and Trademark Office*